United States Patent [19]

Barnett

[11] 4,409,956

[45] Oct. 18, 1983

[54] THERMOSTAT FOR STOVES

[76] Inventor: Stockton G. Barnett, R.D. 3, Salmon River Rd., Plattsburgh, N.Y. 12901

[21] Appl. No.: 183,259

[22] Filed: Sep. 2, 1980

Related U.S. Application Data

[63] Continuation-in-part of Ser. No. 60,629, Jul. 25, 1979, abandoned.

[51] Int. Cl.[3] ..... F23L 13/02

[52] U.S. Cl. ..... 126/290; 126/77; 126/285 A; 126/287.5

[58] Field of Search ..... 126/290, 285 R, 285 A, 126/289, 77, 287.5; 236/45, 101 D, 96, 101 C; 251/11; 123/588; 431/20, 21

[56] References Cited

U.S. PATENT DOCUMENTS

| | | | |
|---|---|---|---|
| 2,350,830 | 6/1944 | Scheu | 126/290 |
| 2,407,743 | 9/1946 | Helyar | 236/45 |
| 2,545,680 | 3/1951 | Wyatt | 126/77 |
| 2,554,370 | 5/1951 | Martin | 126/285 R |
| 2,948,276 | 8/1960 | Harding | 126/77 |
| 3,134,377 | 5/1964 | Kanoy | 236/96 |
| 3,168,088 | 2/1965 | Martin et al. | 236/96 |
| 4,102,629 | 7/1978 | Feinberg | 431/21 |
| 4,117,824 | 10/1978 | McIntire et al. | 126/290 |
| 4,184,473 | 1/1980 | McIntire et al. | 126/77 |

FOREIGN PATENT DOCUMENTS

| | | | |
|---|---|---|---|
| 222300 | 7/1962 | Austria | 126/290 |
| 532713 | 2/1930 | Fed. Rep. of Germany | 126/289 |
| 1232127 | 4/1960 | France | 236/96 |

*Primary Examiner*—Lee E. Barrett

*Attorney, Agent, or Firm*—Ostrolenk, Faber, Gerb & Soffen

[57] ABSTRACT

A thermostat for a stove is disclosed. The thermal control unit is contained in a housing which has an aperture formed therein and includes a thermal control unit for detecting changes in the temperature of the stove. A flap is secured to the housing and is rotatable across the aperture so as to cover the aperture to any desired degree. The thermal control unit controls the position of the flap to control the effective area of the aperture, thereby to control the amount of air supplied to the stove. The thermal control unit, the flap and the aperture cooperate to ensure that the effective area of the aperture changes by an amount approximately proportional to the square of the magnitude of any change in the stove temperature detected by the thermal control unit. The thermal control unit may preferably comprise a bimetallic coil or a liquid expansion thermometer. At least one edge of the flap, or at least one edge of the aperture, or at least one edge of each is curved in such a manner as to produce the desired change in area, in cooperation with the thermal control unit, responsive to stove temperature changes.

32 Claims, 12 Drawing Figures

FIG. 1
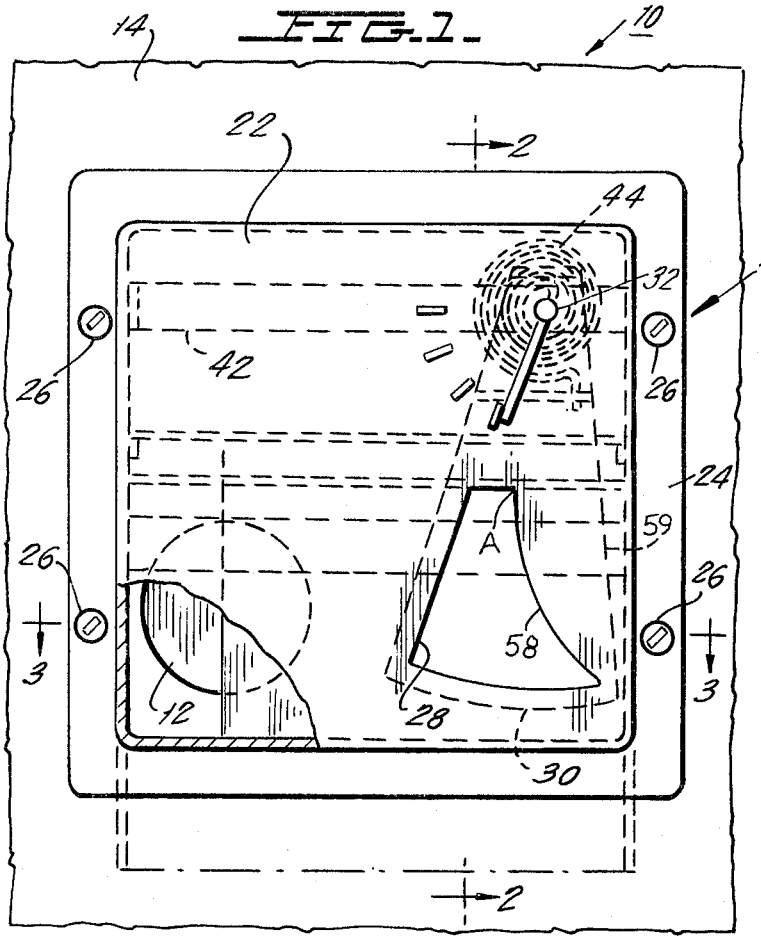
FIG. 2
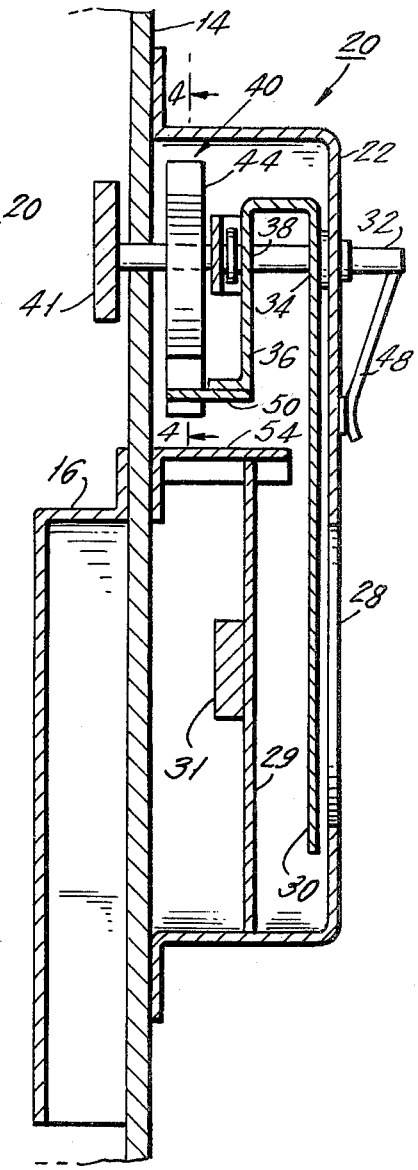
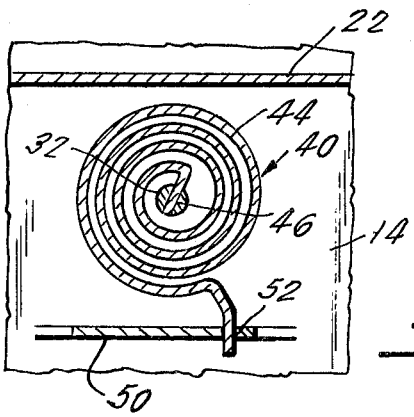
FIG. 4
FIG. 3
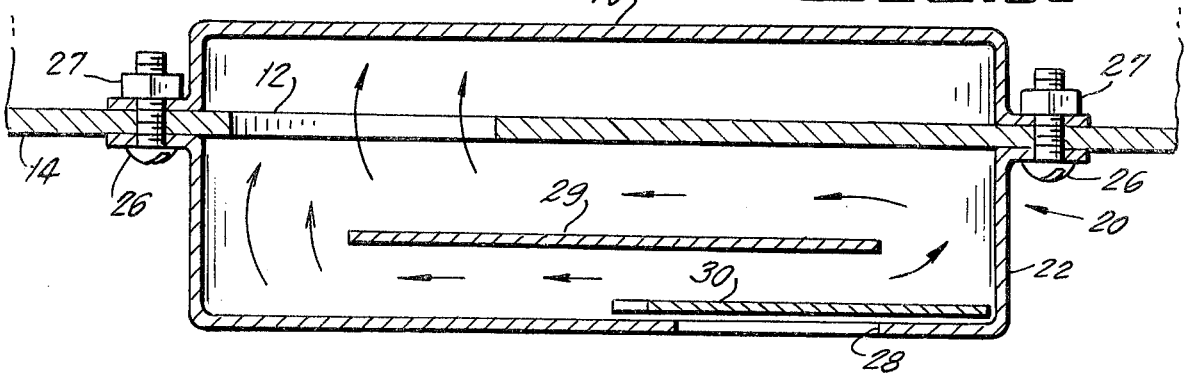

FIG. 10
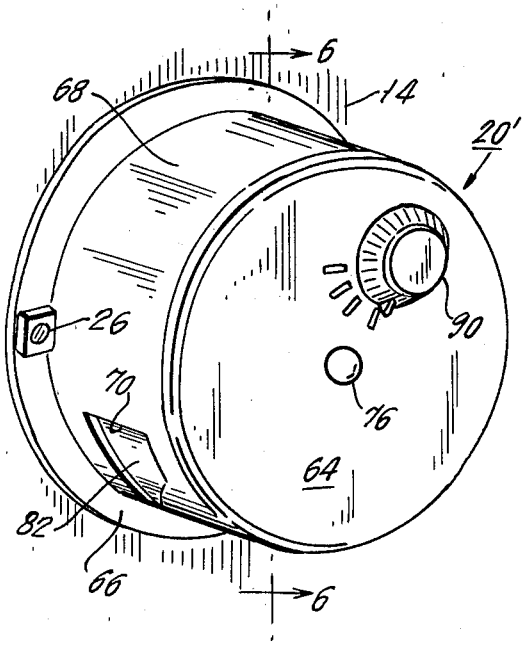
FIG. 11
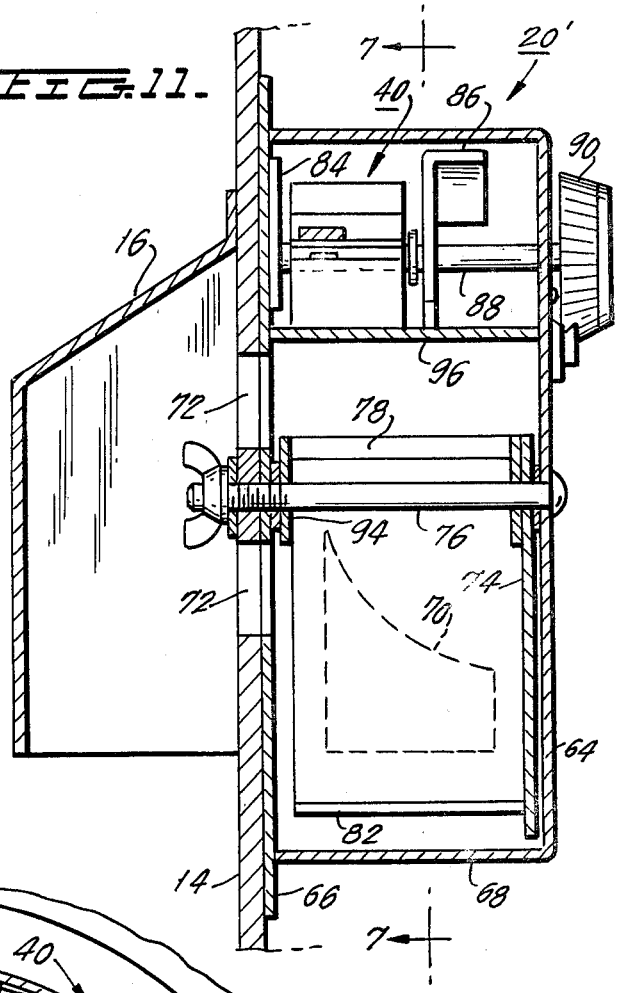
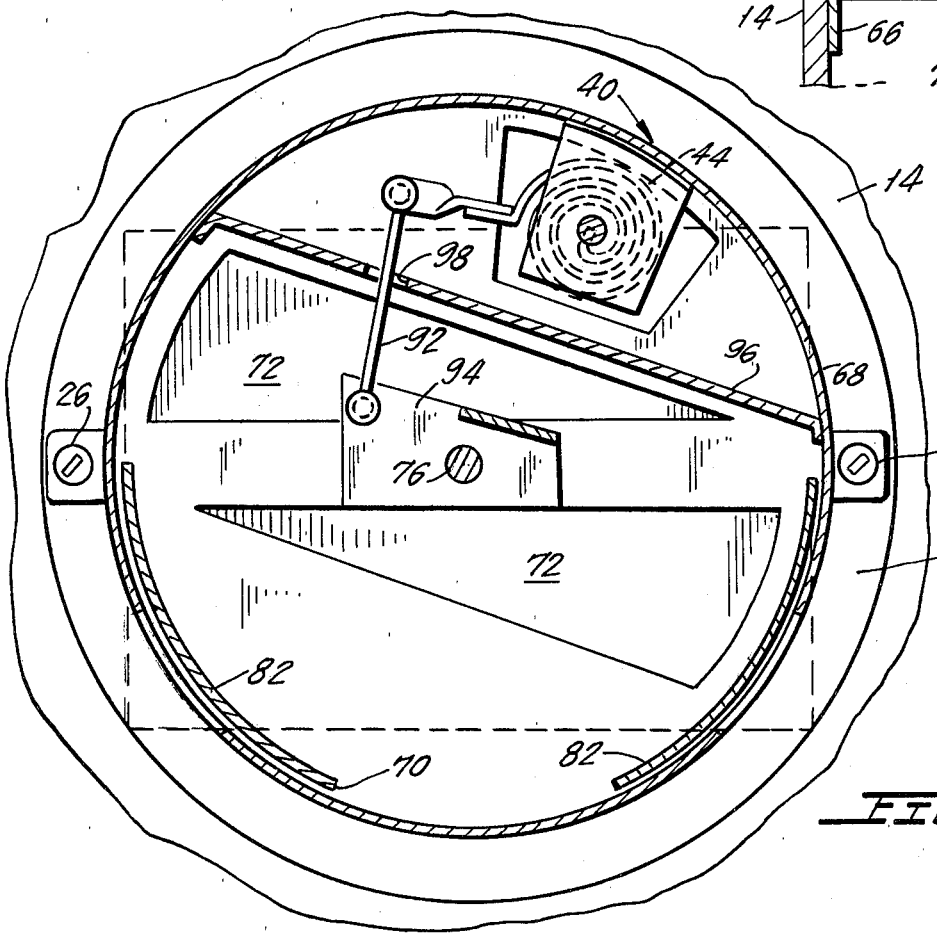
FIG. 12

THERMOSTAT FOR STOVES

RELATED APPLICATIONS

This application is a continuation-in-part of U.S. Patent Application Ser. No. 060,629, filed July 25, 1979, now abandoned for PENDULUM TYPE THERMOSTAT FOR STOVES.

BACKGROUND OF THE INVENTION

The present invention relates to a thermostatically controlled solid fuel burning stove and to a thermostat for such a stove.

Because of the quickly rising prices, or expected shortages, or both, of petroleum and natural gas, people are seeking alternative energy sources, especially for the purpose of heating homes. Fuels such as wood and coal are regaining a measure of their former popularity. As a result, there is a great demand for stoves that will produce heat from wood, coal, etc. as efficiently and safely as possible.

It is highly desirable to control the temperature at which combustion occurs in the stove. When the combustion occurs within the optimum range for heating a room to a desired temperature, the inhabitants of the room will be as comfortable as possible; clearly this will not be the case if the combustion occurs at a higher or a lower temperature or if its temperature oscillates widely. If the combustion temperature is too high, in addition to causing discomfort, the stove will consume more fuel than is necessary. In addition, with the stove at a high temperature, there is a danger of chimney fire due to high stack temperatures which are produced. Finally, an unnecessarily hot stove increases the danger of a person in the room suffering a severe burn from accidentally touching it or the stove igniting something flammable which is near the stove.

If the stove combustion temperature is too low, on the other hand, efficiency is again reduced, excessive CO is formed and there is a danger that the fire will go out, presenting the inconvenience of having to restart it.

Wood burning stoves equipped with thermostats which attempt to maintain the combustion temperature at the desired level are known. Such a stove is disclosed in U.S. Pat. No. 4,117,824, issued Oct. 3, 1978, to McIntire et al. In the McIntire et al. patent, a damper is mounted in an air intake and can be rotated about its edge to control the quantity of air supplied to the stove combustion chamber. This controls the combustion temperature. A bimetallic coil is provided outside the air intake duct. One end of the coil is connected to the damper, and the other end of the coil is connected to a control knob. When the coil heats as a result of a rise in the stove temperature, it rotates and moves the damper in the closed direction. Conversely, a drop in the stove temperature as measured by the bimetallic coil results in the damper being opened further. The position of the damper can also be controlled manually by turning the control knob.

The combustion temperature in wood burning stoves with known thermostats typically exhibits oscillations of a very large amplitude, often reaching 70–300° F. This is because known thermostats typically are not sufficiently sensitive to changes in the stove temperature. Such thermostats generally respond to temperature changes only very slowly and display a response that is very small in magnitude. As a result, by the time the thermostat reduces the air supply responsive to a temperature rise, the temperature has risen very high, and the amount of the reduction in the air supply is correspondingly large. Because of this, the combustion temperature falls dramatically. Due to its relative insensitivity, however, the thermostat detects the temperature drop only after the temperature has fallen as much as 70°–300° F. below its peak. The thermostat responds by drastically increasing the air supply, allowing the combustion temperature to rise very quickly to a new peak. As a result, the stove temperature oscillates wildly, instead of remaining at a stable level.

A stove controlled by such a thermostat thus reaches temperatures both substantially higher and substantially lower than the optimum combustion temperature and accordingly presents many of the risks and suffers from many of the drawbacks of manually controlled stoves.

SUMMARY OF THE INVENTION

It is the principal object of the present invention to provide a thermostat to control a stove in a manner which makes its operation more efficient and safer and which provides greater comfort to its users.

It is another object of the present invention to provide a thermostat which minimizes oscillations in the stove temperature.

It is a further object of the invention to provide a thermostat that controls the stove automatically to attain the above objects.

It is still another object of the invention to provide a thermostat that attains the foregoing objects and yet is simple in construction and highly reliable.

It is still a further object of the invention to provide a thermostat that attains the foregoing objects and that is adapted to be easily retrofitted onto existing stoves.

According to the present invention, a stove is provided with an opening through which air is supplied to oxidize the fuel. The thermostat of the invention is placed on the outer surface of the stove over the opening and controls the rate of air flow therethrough. To this end, the thermostat includes a housing having an opening therein to admit air and includes means for varying the effective size of the opening to thereby control the flow of air into the stove. The surface of the housing containing the opening may be either flat or curved. A flap is provided to adjust the size of the thermostat opening. The flap preferably moves parallel to the surface in which the thermostat opening is formed. A thermal control unit is provided to control the position of the flap relative to the opening as a function of stove temperature. The rate at which air is admitted to the stove is approximately proportional to the effective size of the thermostat opening as determined by the position of the flap.

According to the invention, the thermostat opening, the flap and the thermal control unit cooperate to adjust the effective size of the thermostat opening quadratically with changes in the stove temperature. Particularly, the effective area of the thermostat opening varies approximately in accordance with the following quadratic equation:

$$\Delta A = -k\Delta t^2 \quad (1)$$

wherein $\Delta A$ is the change in the effective size of the opening, k is a positive constant and $\Delta t$ is the change in temperature in the stove. As a result, the flow rate of air through said aperture for a constant pressure differential across said aperture is approximately proportional to the square of the change of temperature of the stove. Stated otherwise:

$$\Delta F = -k\Delta t^2 \quad (1')$$

wherein $\Delta F$ is the change in the flow rate of air through the thermostat. It should be understood that the thermostat need only approximate the relationship expressed in equation (1) to produce the improved results described in some detail below with reference to FIG. 9. For example, a variation from this relationship of approximately five percent (5%) will not significantly degrade the manner in which the thermostat effectively controls the temperature in the stove. On the other hand, the variation of some fifty percent (50%) of the relationship of equation (1) is unacceptable and will produce results substantially identical to the prior art thermostats (see FIG. 8 and the accompanying discussion below).

It has been found that a thermostat having the foregoing characteristics reduces both the magnitude and the length (period) of oscillations in the stove temperature, which oscillations are extremely common with prior art thermostats. This stabilizes the stove temperature and therefore makes the temperature of the room heated by the stove more nearly constant, increasing the comfort of the inhabitants. Since such oscillations are especially common with prior art thermostats after wood is added to the stove and during the charcoal phase (3–8 hours after the beginning of a burn), it will be appreciated that the improvement in comfort afforded by the thermostat of the invention is considerable.

It has also been found that the thermostat of the invention increases the efficiency of the stove, measured in heat produced per weight of wood burn, by at least 15%, the exact amount of the improvement depending upon the stove used.

In addition, since the stove temperature is stabilized, the temperature of the stove can be set just high enough for creosote to cease forming in the flue pipe, thus eliminating a major fire hazard. Finally, since the thermostat is extremely sensitive to stove temperature changes, if a creosote chimney fire should start while no one is attending the stove, the chimney fire will increase stove draft so dramatically that it will cause an increase in the stove's fire, causing the thermostat to shut down and extinguish the chimney fire.

According to one preferred embodiment of the invention, the thermal control unit comprises a bimetallic coil located close to the stove wall (preferably within ¼ inch thereof) and shielded from cool drafts of air. While bimetallic coils have been used in the prior art, they have conventionally been either positioned adjacent the flue, rather than the stove wall, or positioned at a distance of 1–6 inches from the stove wall. When the shorter distance (<¼ inch) is used, it is found that the response time of the thermostat of the invention is reduced to about 10 minutes, compared to the typical response time of ½–1 hour for prior art thermostats.

Moreover, since the change in dimension of the bimetallic coil depends upon the change of temperature experienced by the coil itself, placement of the coil immediately adjacent the stove wall greatly increases the magnitude of the coil response to a change in the stove temperature. As a result, it is possible to use the coil to control the flap position directly, e.g. by connecting one end of the coil directly to the flap. The change in dimension of the coil responsive to stove temperature changes is essentially linear in the temperature range of interest. The quadratic relationship between the effective area of the opening and temperature is effected by making the edges of the flap or the thermostat aperture, or both, curved. If the proper curvature is provided, the change in the effective area of the opening produced by a given movement of the flap will be proportional to the square of the magnitude of the angular movement of the flap.

While close placement of the coil to the stove by itself is sufficient to improve the performance of the thermostat compared to the prior art thermostats at relatively low temperatures and when used with thick-walled stoves, it has been found that when the exterior temperature of the stove wall substantially exceeds 200° F. (and especially when it exceeds 300° F.), the quadratic relationship of air supply to temperature change is essential to minimizing oscillations in the stove temperature. This is also the case with very thin-walled stoves (on the order of 1/16th inch).

One incidental advantage of the thermostat of the invention is that since the flap moves parallel to the surface in which the thermostat aperture is formed, the flap cannot be blown open or shut by sudden gusts of wind.

When a bimetallic coil is used and the flap and thermostat aperture are accordingly curved to provide the quadratic relationship between opening area and temperature, it is very rare that the area of the opening is ever reduced to zero, even at very high stove temperatures. This provides a significant additional advantage over the prior art, for the following reasons. With prior art thermostats, the air supply is often shut off completely when a high temperature is reached. When this occurs, the fire is nearly extinguished, and in order to re-establish it the air supply must be brought to a near maximum value. A sudden large increase in the air supply naturally results in a correspondingly great increase in the intensity of the fire, quickly raising the stove temperature. Prior art thermostats respond by drastically reducing the air supply, which again reduces the fire to a very low level. In this manner, relatively violent oscillations in the stove temperature are produced, with the consequent danger of fire and discomfort to the inhabitants of the room heated by the stove.

The thermostat of the invention, on the other hand, rarely reduces the fire to the point of extinction, because as noted above the area of the opening is rarely reduced to zero. Thus, the opening area need not be increased so drastically for the purpose of re-establishing the fire as is the case with the prior art thermostats. The result is that there is no opportunity for the violent oscillations typical of the prior art to be initiated.

BRIEF DESCRIPTION OF THE DRAWINGS

For the purpose of illustrating the invention, there are shown in the drawings several embodiments which are presently preferred; it is to be understood, however, that the invention is not limited to the precise arrangements and instrumentalities shown.

FIG. 1 shows a view, partly in section, of a first preferred embodiment of the thermostat of the invention.

FIG. 2 shows a sectional view of the thermostat of FIG. 1 as seen from section 2—2 in FIG. 1.

FIG. 3 is another sectional view of the thermostat of FIG. 1 as seen from sectional line 3—3 of FIG. 1.

FIG. 4 is a detail in section of a bimetallic coil used as the thermal control unit in the thermostat of FIG. 1.

FIG. 10 is a view of a second embodiment of the thermostat of the invention.

FIG. 11 is a sectional view of the thermostat of FIG. 10, as seen from section line 6—6 of FIG. 10.

FIG. 12 is another sectional view of the thermostat of FIG. 10, as seen from section line 7—7 of FIG. 11.

DETAILED DESCRIPTION OF THE PREFERRED EMBODIMENT

Figure 5:
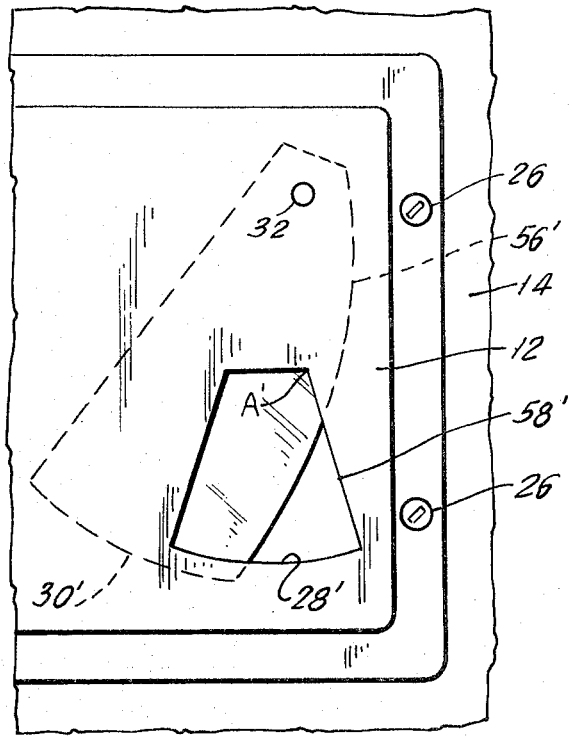
FIG. 5 shows a detail of a variation of the thermostat of FIG. 1, in which the flap has a curved leading edge and the far edge of the aperture is straight.

Referring now to the drawings, wherein like numerals indicate like elements, FIGS. 1–4 show a first embodiment of the present invention designated generally as thermostat 20. Thermostat 20 is coupled to a stove 10 having an aperture 12 provided in one wall 14 thereof. The aperture 12 admits air to the combustion chamber of the stove 10 to oxidize the fuel contained therein. A preheating baffle 16 (FIG. 3) is secured to the inner surface of the stove wall 14. Air admitted through the aperture 14 is preheated by contact with the baffle 16 and is directed downward thereby to the base of the combustion region, both preheating the air and directing it to the base of the combustion zone. The preheating baffle 16 also serves to prevent drafts of cold air from entering the combustion zone directly, deflecting them to the bottom of the combustion zone.

The thermostat 20 is provided on the outer surface of the stove wall 14 and controls the rate of air flow into the combustion chamber of stove 10. The thermostat 20 includes a housing 22, which in the embodiment of FIGS. 1–4 is generally rectangular in shape. The thermostat housing 22 includes a peripheral flange 24 secured to the stove wall 14 by screws 26 and nuts 27, which also serve to secure the preheating baffle 16 to the stove wall 14 (FIG. 3). An aperture 28 is formed in the front wall of the thermostat housing 22 and cooperates with a flap 30 and a coil 44 to vary the flow of air into housing 22 and thence into the combustion chamber of stove 10. It will be noted that the thermostat aperture 28 is offset horizontally from the stove aperture 12. This prevents the entry combustion chamber of drafts of cold air into the stove. For the same purpose, a baffle 29 is mounted inside the thermostat housing 22, between and parallel to the stove wall 14 and the front wall of the housing 22. The baffle 29 is secured to the housing 22 and supported by support bar 31. The flow of air through thermostat aperture 28, around baffle 29 and through the stove aperture 12 into the preheating baffle 16 is indicated by the arrows in FIG. 3. Flap 30 is mounted inside the thermostat housing 22 for rotation about shaft 32, to control the effective size of aperture 28. By rotation of the flap 30, it is possible to open aperture 28 completely, to close it completely or to open it to any intermediate degree that may be desired. The upper end 36 of flap 30 is bent away from the front surface of the housing 22 and folded down in the shape of a "U" as shown in FIG. 2. The portion 36 of the flap 30 which is bent backward and folded down is mounted on shaft 32 and is rotatable thereabout. Thus, the flap 30 is supported by shaft 32 at two points 34, 38. As best shown in FIG. 2, flap 30 lies immediately behind the front wall of the thermostat housing 22 and is rotatable in a plane parallel thereto.

A thermal control unit 40 is also contained in the thermostat housing 22 and is supported by a support bar 42. In the preferred embodiment shown in FIGS. 1–4, the thermal control unit 40 comprises a bimetallic coil 44 in the form of a spiral, although other shapes could also be used. The bi-metallic coil 44 has its inner end connected to shaft 32, as, for example, by the insertion of the inner end of the coil 44 into a slot 46 in shaft 32. See FIG. 4. The shaft 32 extends through the support bar 42 and the front surface of the housing 22, with respect to both of which it is rotatable. The end of the support shaft 32 that projects through the housing 22 is provided with a pointer 48, which serves a purpose described below.

The bent-over portion 36 of the top of the flap 30 is secured to the outer end of the bimetallic coil 44. This may be achieved, for example, by providing a flange 50 projecting rearward from folded-over portion 36 of the flap 30 and inserting the outer end of the coil 44 into a slot 52 provided in the flange 50, as shown in FIG. 4, or by welding or in any other suitable way.

The bimetallic coil 44 of the thermal control unit 40 is located within thermostat housing 22 in such a manner as to be in good thermal contact with the stove 10. For this purpose, the bimetallic coil 44 is preferably located approximately ¼ inch from the stove wall 14. Such a close placement of the coil 44 to the stove wall 14 ensures that the coil 44 will respond quickly to changes in the stove temperature. The coil 44, due to its proximity to the stove wall 14, experiences greater temperature changes responsive to changes in the stove temperature than the prior art coils, which are placed typically 1–6 inches from the stove wall. As a result, the magnitude of the coil's response to a temperature change is sufficient to permit the coil 44 to be used to control the position of the flap 30 directly, as will be described below. In order to ensure that the coil 44 responds quickly and accurately to changes in the stove temperature, a baffle 54 is provided in the thermostat housing 22 immediately below the coil 44 to protect the coil 44 from drafts of air created by the flow of air into the combustion chamber of stove 10. The baffle 54 also protects the coil 44 from soot.

In the embodiment shown in FIGS. 1–4, the thermal control unit 40 is made still more sensitive to temperature changes in the stove 10 in the following manner. Shaft 32 is extended through stove wall 14 and into the interior of the stove 10. A plate 41 of a highly heat-conductive material such as aluminum is secured to the end of shaft 32. The plate 41 acts as a heat sink, ensuring that the thermal control unit 40 is in good thermal contact with the combustion chamber of the stove 10. The end of shaft 32 need only extend far enough into the stove interior to permit the plate 41 to be secured thereto. The shaft 32 is preferably brass or aluminum.

When the stove combustion chamber temperature rises, the bimetallic coil 44 expands. Because the two metals of which the coil 44 is made have different coefficients of thermal expansion, the arc length of the coil increases, and the outer end of the coil 36 moves counterclockwise (in FIGS. 1 and 4), rotating the flap 30 in the same direction about the support shaft 32.

The bimetallic coil 44 is arranged in housing 22 such that when the stove temperature is low, i.e. below about 200° F., the flap is well to the left, as viewed in FIG. 1, and the thermostat aperture 28 is largely or completely unobstructed. As the stove temperature rises, the flap 30 is gradually moved counterclockwise, obstructing a progressively larger portion of the thermostat aperture 28 and thus reducing the air supply to the stove 10. Conversely, when the stove temperature falls, and more air is necessary to maintain combustion at the desired rate, the flap 28 is moved clockwise, enlarging the effective size (i.e., the unobstructed portion) of aperture 28 and increasing the air supply to the stove 10. In this manner, a proper air supply is assured.

The essential feature of the present invention is that the thermal control unit (in the embodiment of FIGS. 1–4 the bimetallic coil 44), the thermostat aperture 28 and the flap 30 cooperate to ensure that when the stove temperature drops by a given amount, the air supplied to the stove 10 is increased by an amount approximately proportional to the square of the drop in the stove temperature and that conversely, when the stove temperature rises, the air supply is decreased by an amount approximately proportional to the square of the temperature rise. Stated otherwise, it is essential that the flow of air through the thermostat varies approximately in accordance with equation (1′), supra, at least from the fully closed to the partially open portion of the thermostat.

It has been found that in the temperature range of importance to the present invention, the response of the bimetallic coil is typically more or less linear. Accordingly, in the embodiment of FIGS. 1–4, the quadratic relationship between the air supply and changes in the stove temperature is effected by the choice of the shape of the thermostat apertures 28 and the flap 30. In the embodiment shown in FIGS. 1–4, the leading edge 56 of the flap 30 is straight, while the far edge 58 of the thermostat aperture 28 is curved in such a manner as to effect the necessary quadratic relationship (Equation (1′)). Once the front edge 59 of the flap 30 reaches point A of the edge 58, the size of the opening (and, therefore, the variation in flow rate) will no longer vary as a quadratic function of the opening. Rather, it will vary generally linearly.

Figure 6:
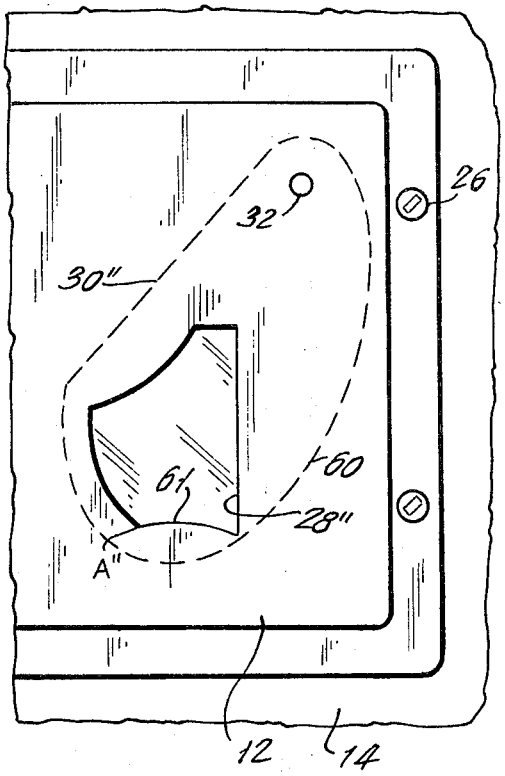
FIG. 6 shows a view similar to FIG. 5 of a second variation of the thermostat of FIG. 1, in which both the leading edge of the flap and various edges of the aperture are curved to produce the desired variation of effective opening area with temperature.

As shown in FIG. 5, however, the invention can also be carried out by providing a thermostat aperture 28′ whose far edge 58′ is straight, and a flap 30′ whose edge 56′ has such a curvature as to effect the quadratic relationship between air supply and stove temperature change from the fully closed to the partially open position (corresponding to point A′ of edge 58′) of the thermostat. Alternatively, as shown in FIG. 6, the flap 30″ and thermostat aperture 28″ can both be provided with curved edges 60 and 61, respectively. The exact curvatures of the aperture's far edge 58 (FIGS. 1–4), the flap's leading edge 56′ (FIG. 5) and edges 60 and 61 (FIG. 6) are not important provided that the shapes of the flap and of the aperture cooperate to effect the necessary relationship from the fully closed to the partially open positions (corresponding to points A, A′ and A″ in FIGS. 1, 5 and 6, respectively).

If a thermal control unit 40 other than a bimetallic coil is used, it is possible that the thermal control unit 40 will display a non-linear response to temperature change. In this case, it will be appreciated that the curvatures of the flap and thermostat aperture must be varied from those of FIGS. 1–6, in order that the flap, the thermostat aperture and the thermal control unit together will approximate the necessary overall quadratic characteristic.

Figure 7:
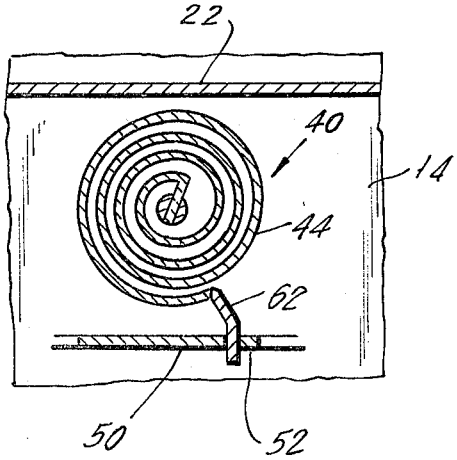
FIG. 7 is a view corresponding to FIG. 4 showing a further modification of the thermostat of FIG. 1.

A portion of another variation of the embodiment of FIGS. 1–4 is shown in FIG. 7, which is a view corresponding to FIG. 4. In FIG. 7, the outer end of the bimetallic coil 44 is replaced with a link 62 of a fusible metal. The link 62 is connected to the bimetallic coil 44 in any suitable known manner and can be connected to the flap 30 in the same manner as is used in the embodiment of FIGS. 1–4.

The metal of which link 62 is made is selected to have a predetermined melting point. Thus, when the stove temperature approaches the melting point of the fusible link 62, the link 62 either melts or, weakened by softening due to the temperature rise, breaks under the weight of the flap 30. The flap 30 is then free to fall into the position in which it completely closes the thermostat aperture 28, cutting off the air supply to the stove 10, and allowing the fire therein to die. Thus, the fusible metal link 62 prevents dangerously high temperatures from being reached and so serves as a guard against the hazard of fire.

Figure 8:
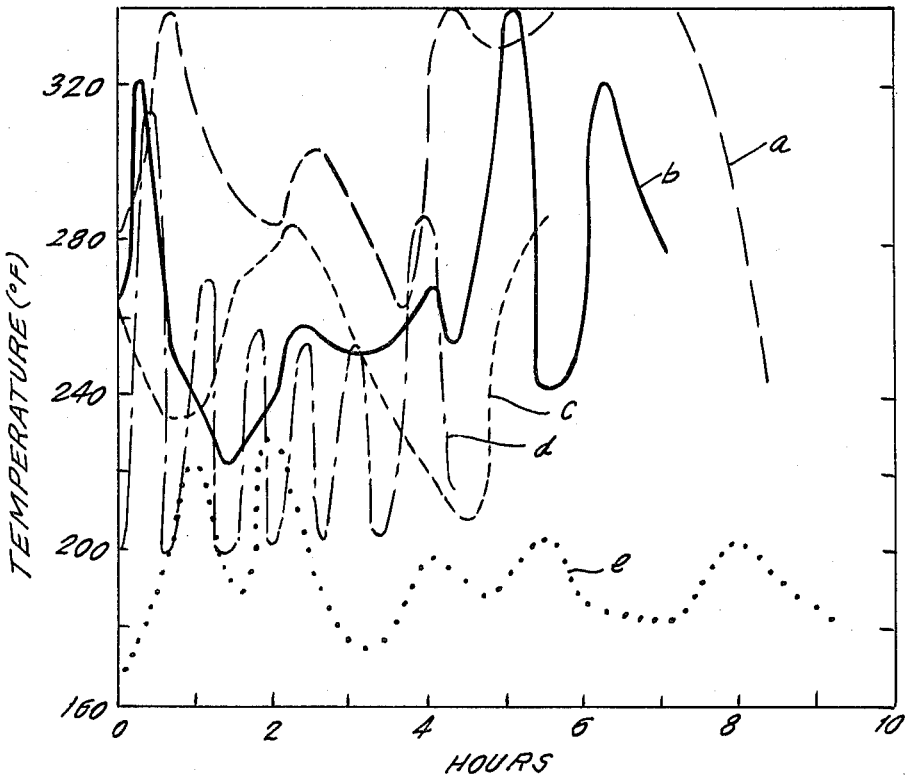
FIG. 8 is a graph showing the variation in the temperature of various commercially available stoves using prior art thermostats.
Figure 9:
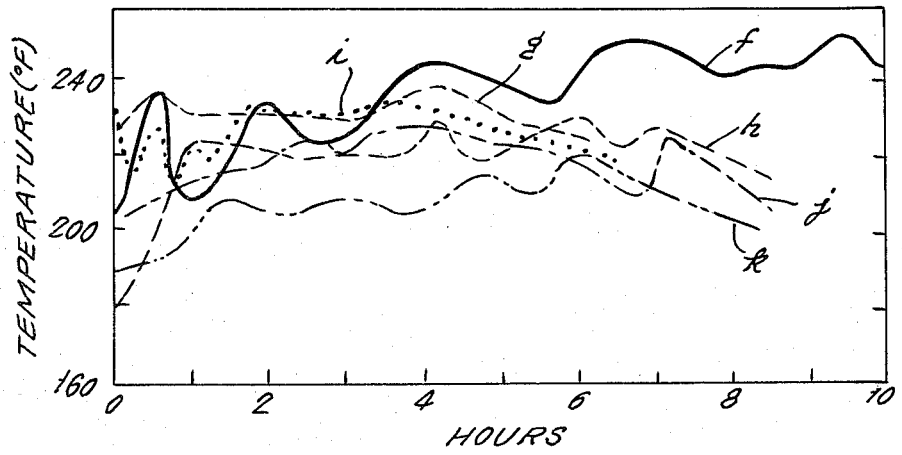
FIG. 9 is a similar graph showing the performance of various prior art stoves using the thermostat of the invention.

FIGS. 8 and 9 show a comparison of the performance of the thermostat of the invention with that of some commercially available stoves that are thermostatically controlled according to the prior art. FIG. 8 shows the stove temperature of five commercially available stoves controlled by prior art thermostats, as a function of time. As can be seen, oscillations of great magnitude result with all of the conventional thermostats whose performance is shown in FIG. 8. The stoves represented by curves a-e each experienced oscillations in temperature having an amplitude of between 60° and 100° F. Even greater magnitudes have been observed on other stove types.

FIG. 9 shows the results of several tests of the performance of two stoves controlled by the thermostat of the invention. Six consecutive test runs are shown. As can be seen, the curves of FIG. 9 are relatively even, with few of them experiencing oscillations having an amplitude of over 25°–30° F. and all of them varying relatively slowly. Curve g in FIG. 9 was obtained using a stove identical to that whose performance with a conventional thermostat is shown as curve b in FIG. 8.

Another preferred embodiment, which is especially designed to be used in retrofitting stoves with the thermostat of the invention, is shown in FIGS. 10–12. In this embodiment, the thermostat 20′ is housed in a cylindrical housing 64 which is provided about its periphery with a flange 66 secured to the stove wall 14 by means of nuts and screws 26. The lateral wall 68 of the thermostat housing 64, which wall 68 has the form of a cylindrical shell, has two identically-shaped thermostat apertures 70 formed therein. The two thermostat apertures 70 are located symmetrically about an imaginary vertical plane which divides the thermostat 20′ into right and left halves. The air admitted via the thermostat apertures 70 passes through apertures 72 in the stove wall 14. The stove apertures 72 may be the original draft openings provided by the manufacturer of the stove or may be cut in the stove wall 14 when the stove is retrofitted with the thermostat 20'. Because the thermostat apertures 70 are located symmetrically with respect to a vertical plane passing through the thermostat, ample air flows through the apertures 70 and the apertures 72 regardless of the exact shape and size of the stove apertures 72.

In order to control the flow of air through thermostat apertures 70, the following apparatus is provided. A plate 74, having the shape of a half disk, is mounted in the thermostat housing 64 parallel to the front face thereof (see FIG. 11). It is mounted rotatably on a support bolt 76. A support bridge 78 extends perpendicularly from the rear surface of plate 74. The rear end of support bridge 78 is also rotatably mounted on support bolt 76, so that plate 74 is stably supported. The bolt 76 also serves to secure the thermostat 20' to the stove wall 14. It passes through hole 80 formed in the stove wall 14, which hole 80 may, if convenient, be the hole provided by the stove manufacturer for mounting the draft flap or spindle of the original thermostat. Secured to and preferably integral with plate 74 are two arcuate flaps 82, one for each thermostat aperture 70. Flaps 82 each have the form of a segment of a cylindrical shell. By rotating plate 74 about support bolt 76, the flaps 82 can be made to close thermostat apertures 70 to any desired degree.

A thermal control unit 40 is supported in the thermostat housing 64 by means of support brackets 84 and 86. The thermal control unit 40 is kept in close thermal contact with the stove interior, and to that end may be provided with a brass or other heat conductive rod (not shown in this embodiment; see FIG. 2) penetrating the stove wall 14, especially in the case of a very thin-walled stove (1/16 inch or less thick).

The thermal control unit 40 shown in FIG. 12 is a bimetallic coil 44 substantially identical to that of the embodiment of FIGS. 1–4. The inner end of the coil 44 is secured to a control rod 88 one end of which projects through the front face of the thermostat housing 64 and is connected to a control knob 90. The outer end of the coil 44 is connected to the upper end of an actuating rod 92. The other end of actuating rod 92 is connected to a plate or block 94 which is secured to plate 74. Support bridge 78 may serve as the block 94, if desired. Rod 92 is connected to block 94 in such a manner that movement of the outer end of the coil 44 exerts a torque on plate 74 about the support bolt 76, causing the plate 74 to rotate thereabout. The point of connection of rod 92 to block 94, the bimetallic coil 44 and rod 92 are so located that when the stove temperature rises, expanding the coil, plate 74 is caused to rotate clockwise (as seen in FIG. 12) and thereby to move the flaps 82 across their respective thermostat aperture 70, closing the latter. Conversely, when the stove temperature falls, the coil 44 shrinks and, via rod 92, pulls the flaps 82 in the clockwise direction, opening the thermostat apertures 70 wider.

As in the embodiment of FIGS. 1–4, the coil 44 responds linearly to changes in the stove temperature. Accordingly, each thermostat aperture 70 has one edge curved with a curvature such that when a flap 82 is rotated to modify the air flow to the stove, the change in the rate of air flow is proportional to the square of the magnitude of the temperature change.

This curved edge, in the case of each thermostat aperture 70, is located at the counterclockwise-most portion of the aperture 70 (called the "far edge" of the aperture 70 herein).

In order to protect the thermal control unit 40 from the effect of sudden drafts, it is isolated in the thermostat housing 64 by barrier 96. A hole 98 is provided in barrier 96 to allow passage of the rod 92.

It is possible to control the relationship between stove temperature and air supply rate by means of the control knob 90. When the control knob 90 is turned clockwise, for example, the entire bimetallic coil 44 is rotated clockwise with it. This in turn rotates plate 74 and flaps 82 clockwise, via rod 92, increasing the rate at which air is fed to the stove. Conversely, if it is desired to decrease the rate at which air is fed to the stove at a given temperature, the control knob 90 is turned counterclockwise.

The embodiment of FIGS. 10–12 can be varied in each of the manners described above in connection with the embodiment of FIGS. 1–4. For example, instead of the thermostat apertures 70 having a curved edge, they can be formed so that their peripheries have no curvature except the curvature of the cylindrical lateral wall 68 of the thermostat housing 64. In this case, the leading edges (the counterclockwise-most edges) of the flaps 82 can be made curved, as in FIG. 5.

Again, both the flaps 82 and thermostat apertures 70 can be made with curved edges, as in FIG. 6.

In any of the embodiments shown, the thermal control unit 40 can also be a liquid expansion mechanism of the conventional type in which the expansion and contraction of a liquid responsive to stove temperature changes moves a control rod to control the position of the flap 30 or flaps 82.

The improvements in comfort and safety that are provided by the thermostat of the invention are indicated by the relatively smooth curves of the graph of FIG. 9. Both the magnitude and the frequency of the variations in stove temperature are generally reduced to a great extent compared to the prior art. This is because the thermal control unit of the invention has a response time of only about ten minutes, or one minute (if probe and inside plate are used) compared to a response time of a half hour to an hour with a conventional thermostat, and because of the quadratic relationship which the thermostat of the invention establishes between the air intake area and temperature changes in the stove.

The present invention may be embodied in other specific forms without departing from the spirit or essential attributes thereof and, accordingly, reference should be made to the appended claims, rather than to the foregoing specification, as indicating the scope of the invention.

What is claimed is:

1. A thermostat for a stove, comprising:

a housing having a thermostat aperture formed in a surface thereof;

flap means movably secured to said housing and being movable in a manner which adjusts the effective size of said thermostat aperture between a fully open and a fully closed position; and thermal control unit means contained in said housing for detecting changes in the temperature of a stove to which said thermostat is attached and for moving said flap means as a function of said change in temperature; said flap means, said thermostat aperture and said thermal control unit means cooperating to cause the flow rate of air through said thermostat for a constant pressure differential across said thermostat to change by an amount approximately proportional to the square of said change in the temperature of said stove over a range of thermostat openings extending from at least said fully closed position to at least a partially open position, said flow rate being increased responsive to a fall in the stove temperature and being decreased responsive to a rise in the stove temperature.

2. The thermostat of claim 1, wherein said thermal control unit means has a substantially linear response to changes in the stove temperature.

3. The thermostat of claim 2, wherein said thermal control unit means comprises a bimetallic coil.

4. The thermostat of claim 3, wherein said bimetallic coil has an outer end secured to said flap means for moving said flap means responsive to a change in the stove temperature.

5. The thermostat of claim 4, wherein said housing includes an open end adapted to be coupled to a stove, said open end lying in a plane, said bimetallic coil being accommodated in said housing and located within approximately ¼ inch of said plane.

6. The thermostat of claim 3, wherein said thermal control unit further comprises a control rod, said bimetallic coil having an outer end connected by means of said control rod to said flap means for moving said flap means responsive to the change in the temperature of the stove.

7. The thermostat of claim 3, further comprising a control knob, said bimetallic coil having an inner end connected to said control knob, said control knob adjusting the orientation of said bimetallic coil to determine the value of said flow rate at a given temperature.

8. The thermostat of claim 2, wherein said flap means is slidable with respect to said aperture and wherein said flap means and said thermostat aperture have respective predetermined shapes such that when said thermal control unit means moves said flap means a given amount, the respective said shapes of said flap means and of said thermostat aperture cooperate to change the effective area of said aperture by an amount approximately proportional to the square of the magnitude of said change in the stove temperature.

9. The thermostat of claim 8, wherein said flap means has a straight leading edge and said thermostat aperture has a curved edge.

10. The thermostat of claim 8, wherein said flap means has a curved leading edge and said thermostat aperture has a straight edge facing said leading edge.

11. The thermostat of claim 8, wherein said flap means has a curved leading edge and said thermostat aperture has a curved edge.

12. The thermostat of claim 1, wherein said thermal control unit means comprises a liquid expansion thermometer.

13. The thermostat of claim 1, wherein said housing is generally rectangular in form.

14. The thermostat of claims 1, 4 or 5 wherein said housing is cylindrical.

15. The thermostat of claim 14, wherein said cylindrical housing includes a cylindrical lateral surface, said thermostat aperture being formed in said cylindrical lateral surface.

16. The thermostat of claim 14, wherein said thermostat aperture defines a first thermostat aperture and said flap means defines a first flap means and wherein said thermostat further includes a second thermostat aperture, both of said thermostat apertures being formed in said cylindrical lateral surface.

17. The thermostat of claim 16, wherein said thermostat further includes a second flap means, said second flap means being secured to said housing and movable in a manner which adjusts the flow rate of air through said second thermostat aperture, said first and second flap means being slidable with respect to said first and second apertures, respectively, and being secured to each other in such a manner that the flow rate of air through said first and second thermostat apertures are at all times the same.

18. The thermostat of claim 17, wherein said first and second thermostat apertures have the same shape.

19. The thermostat of claim 1, further comprising a flange integral with said housing for securing said thermostat to a stove.

20. The thermostat of claim 19, further comprising a baffle secured to said housing for protecting said thermal control unit means from drafts of air.

21. The thermostat of claim 1, wherein said housing has an open end adapted to be coupled to said stove and wherein said thermostat further comprises baffle means secured to said housing in such a manner that air entering said thermostat via said thermostat aperture must move around said baffle means in order to reach said open end of said housing.

22. The thermostat of claim 1, further including shut off means for causing said flap means to close said aperture and thereby cut off air flow through said aperture whenever the temperature in said housing rises above a predetermined level.

23. The thermostat of claim 4, further including shut off means for causing said flap means to close said aperture and thereby cut off air flow through said aperture whenever the temperature in said housing rises above a predetermined level.

24. The thermostat of claim 23, wherein said shut off means includes a fusible link coupling said bimetallic coil to said housing and adapted to melt when said temperature in said housing rises above said predetermined level.

25. A stove having a thermostat control, comprising:

a stove, said stove having a wall and said wall having an air inlet aperture formed therein;

a housing having a thermostat aperture formed in a surface thereof;

means for securing said housing to said stove at a location on said stove such that air which enters said housing via said thermostat aperture will enter the stove via said air inlet aperture;

flap means movable with respect to said thermostat aperture in a manner which adjusts the effective size of said thermostat aperture between a fully closed and a fully opened position; and thermal control unit means contained in said housing for detecting changes in the temperature of said stove and for moving said flap means as a function of said change in temperature of said stove; said flap means, said thermostat aperture and said thermal control unit means cooperating to cause flow rate of air through said thermostat, for a constant pressure differential across the thermostat, to change by an amount approximately proportional to the square of said change in said stove temperature over a range of thermostat openings extending from at least said fully closed position to at least a partially open position, said flow rate being increased responsive to a fall in the stove temperature and being decreased responsive to a rise in the stove temperature.

26. The stove of claim 25, further comprising means for placing said thermal control unit into direct thermal contact with the interior of said stove.

27. The stove of claim 26, wherein said direct thermal contact means comprises a thermally conductive rod in contact with said thermal control unit means and penetrating said wall of said stove, and a thermally conductive plate secured to said rod in the interior of said stove.

28. The stove of claim 27, wherein said plate and said rod are brass.

29. The stove of claim 27, wherein said plate and said rod are aluminum.

30. The stove of claim 25, 26 or 27, wherein said wall of said stove has a thickness no greater than approximately 1/16 inch.

31. The stove of claim 25, further including shut off means for causing said flap means to close said aperture and thereby cut off air flow to said stove whenever the temperature in said stove rises above a predetermined level.

32. The stove of claim 31, wherein said thermal control unit means includes a bimetallic coil which controls the position of said flap means and wherein said shut off means includes a fusible link coupling said bimetallic coil to said housing and adapted to melt when said temperature in said stove rises above said predetermined value.

* * * * *